United States Patent [19]

Shaw

[11] 4,178,767

[45] Dec. 18, 1979

[54] REVERSE FAN HEAT PUMP DEFROST CONTROL SYSTEM

[75] Inventor: David N. Shaw, Unionville, Conn.

[73] Assignee: Dunham-Bush, Inc., West Hartford, Conn.

[21] Appl. No.: 917,040

[22] Filed: Jun. 19, 1978

[51] Int. Cl.[2] ..... F25B 13/00

[52] U.S. Cl. ..... 62/155; 62/186; 62/324

[58] Field of Search ..... 62/155, 158, 186, 81, 62/324 F, 324 R

[56] References Cited

U.S. PATENT DOCUMENTS

| | | | |
|---|---|---|---|
| 3,063,250 | 11/1962 | Moorman | 62/155 |
| 3,845,637 | 11/1974 | Shepherd | 62/155 X |

*Primary Examiner*—William E. Wayner

*Attorney, Agent, or Firm*—Sughrue, Rothwell, Mion, Zinn and Macpeak

[57] ABSTRACT

A defrost control system includes in an electrical control circuit, a number of relay coils and contacts responsive thereto for insuring a delay in termination of the defrost mode and reverse refrigerant flow to the outdoor coil of the heat pump system to delay coil operation as an evaporator, and to effect automatically fan motor reversal and energization to blow air downwardly over the outdoor coil fins to assist gravity in removing the condensate during delay in initiation of heat pump heating cycle, thereby preventing refreezing of condensate on the coil fins.

7 Claims, 4 Drawing Figures

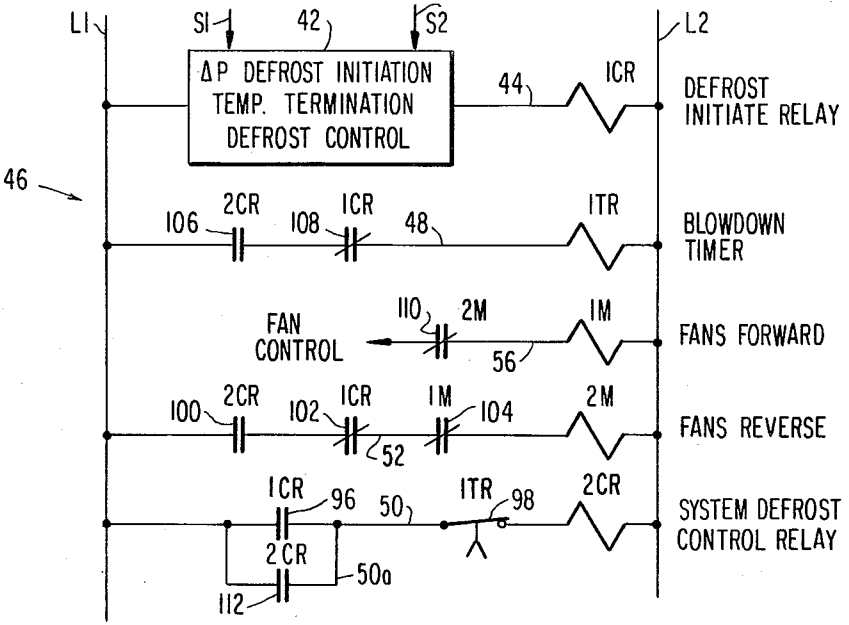
FIG. 2
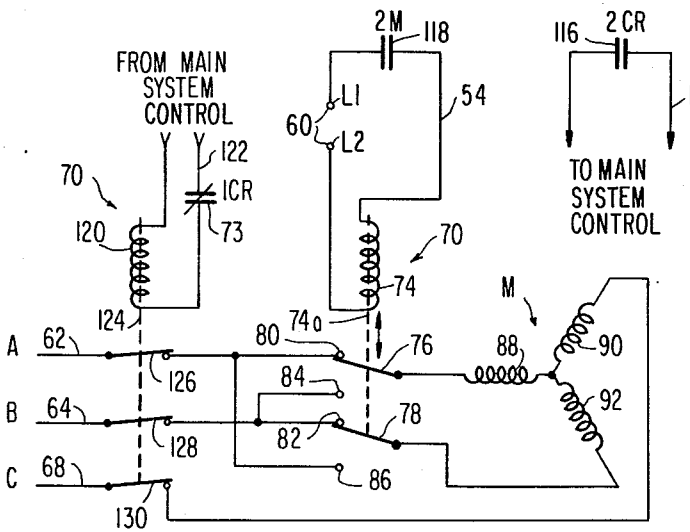
FIG. 1A
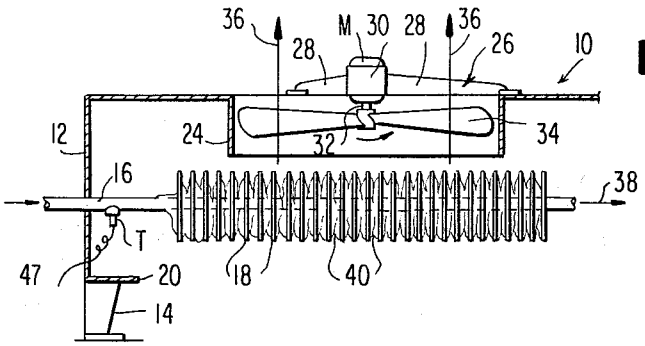
FIG. 1B
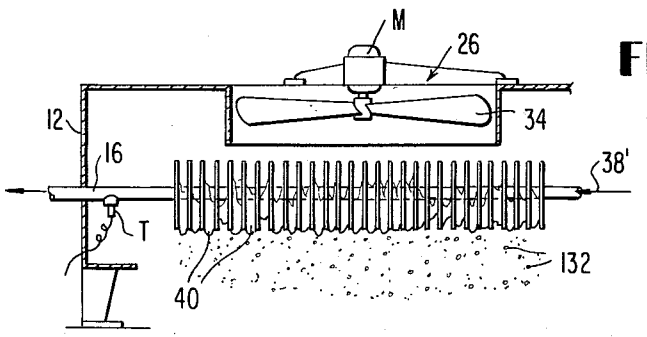
FIG. 1C
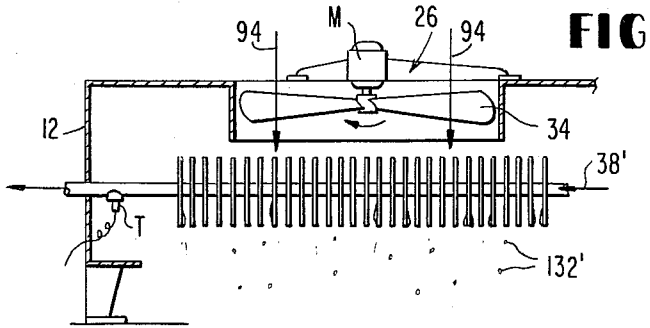

REVERSE FAN HEAT PUMP DEFROST CONTROL SYSTEM

FIELD OF THE INVENTION

This invention relates to reverisble refrigeration systems, and more particularly, to heat pump systems where the heat pump changes from heating to cooling mode momentarily during defrost to melt the frost accumulating on the outdoor coil by supplying hot refrigerant vapor from the compressor directly to that coil.

BACKGROUND OF THE INVENTION

Heat pump systems for home and commercial buildings comprise a reversible refrigeration system including in indoor coil mounted within the interior of the building being conditioned, and an outdoor coil subjected to ambient air flow. The indoor and outdoor coils trade functions as evaporator and condenser, based on heating or cooling needs for the space to be conditioned. Normally, the heat pump system includes a reversing valve for reversing the flow of refrigerant to and from the compressor relative to the indoor and outdoor coils which are connected in series with the compressor. During cooling mode, the indoor coil becomes the evaporator for the system, and the outdoor coil becomes the condenser. During the heating mode, these coils trade functions, that is, the indoor coil becomes the condenser rejecting heat to the interior of the building, while the outdoor coil becomes the evaporator, picking up heat from the air passing over the outdoor coil. Conventionally, the outdoor coil consists of a number of turns of tubing bearing the refrigerant and normally occupying a horizontal plane. The tubing carries a plurality of closely spaced metal heat exchange fins which project vertically in parallel or side by side fashion. In order to effect the proper heat exchange between the outside air and the refrigerant within the tubing, such outdoor coil assembly further comprises one or more electric motor driven fans which may be either positioned above or below the outdoor coil. The fans operate to force air upwardly through the fins and maximizing heat transfer between the ambient air and the refrigerant within the coil tubing.

When the outdoor functions as an evaporator, particularly at temperatures near freezing, there is a tendency for the moisture within the air stream to condense on the coil tubing and the fins and to be frozen by contact with these heat conductive members which are below freezinfg temperature. The build-up of the frozen condensate causes a restriction in the air flow between the fins, resulting in inefficient heat transfer between the forced air and the refrigerant within the coil itself. This decreased the thermal efficiency of the system. Further, this requires the manufacturer of the outdoor coil to provide fins which are spaced relatively far apart to insure that the presence of the frozen condensate will not totally block air flow over the outdoor coil when the fan motors are energized.

Further, it is necessary to periodically defrost the outdoor coil. Attempts have been made to provide electrical resistance heaters which are mounted to the outdoor coil and, upon energization of the heaters, the generated heat tends to melt the frozen condensate. This normally is achieved at cessation of heat pump operation.

It has been determined that since the refrigerant vapor being discharged from the compressor is at relatively high temperature, by momentary cyclic mode reversal of the heat pump itself, the outdoor coil can be changed from its evaporator function to condenser function, and permit the hot refrigerant vapor discharging from the compressor to achieve defrosting of the coil. Such heat pump systems incorporating reversal of refrigerant or cyclic mode reversal have been fairly successful in achieving the partial removal of the condensate without materially adversely affecting the function of the system in maintaining proper temperature conditions within the environment being conditioned. In most cases, adequate controls are provided to the heat pump or reversible refrigeration system for both reversing the refrigerant flow, causing the outdoor coil to function as a condenser and terminating fan operation so that the melted condensate simply falls downwardly under the influence of gravity from the fins bearing such frozen condensate.

Such control systems are responsive to a signal such as pressure differential for the refrigeration system components in terms of the refrigerant within the closed refrigerant loop including the outdoor and indoor coils as a means for determining the necessity for defrost action, and a further signal indicative of the temperature of the refrigerant within the outdoor coil itself for terminating such defrost. However, in systems to date, the termination of the defrost action usually results in the immediate return of the outdoor coil to its evaporating function with reversal of refrigerant flow within the system, and the energization of the fan motor so as to continue to force the air upwardly over the outdoor coil and particularly the surfaces of the fins. Usually, there remains on the fins some melted condensate which immediately refreezes as a result of the outdoor coil initiating its evaporating function, and at the same time the upward movement of the air flow acts in opposition to gravity and tends to maintain the water droplets on the surface of the fins. Thus, there occurs the refreezing of the condensate in direct opposition to the desired need for complete removal of the condensate.

It is therefore a primary object of the present invention to provide an improved defrost control system for a reversible refrigeration heat pump system which will insure the complete removal of melted condensate prior to the re-initiation of the outdoor coil evaporating function.

It is a further object of the present invention to provide an improved defrost control system for a heat pump or the like in which forced air flow during the termination of the defrost action is provided to assist gravity in the removal of the melted condensate from the fins of the outdoor heat exchange coil.

SUMMARY OF THE INVENTION

The present invention is directed to a reversible refrigeration system, particularly a heat pump system which includes a finned outdoor coil acting selectively as a refrigeration condenser and evaporator with a fan mounted adjacent the coil for blowing air upwardly and across the heat exchange coil fins for effecting heat exchange between the moving air and the refrigerant within the coil tubing. The system is normally provided with control means responsive to frost accumulation on the fins of the outdoor coil when the outdoor coil is acting as an evaporator under near freezing ambient conditions to effect a change in heat pump mode from heating to cooling mode and to initiate defrosting of the coil by supplying hot refrigerant vapor thereto while terminating fan operation. The improvement resides in providing a reversible direction fan and control means for first delaying the termination of the defrost mode and the initiating of the heating mode for the heat pump and, secondly, provide reverse direction forced air flow over the coil to act in conjunction with gravity to remove the last of the melted condensate from the fins prior to re-initiating heat pump system heat cycle operation.

Preferably, the fan comprises a reversible fan drive motor and the control system comprises an electrical circuit including a voltage source; a first control line across the source comprising a defrost initiate relay coil and a control panel including means for closing the first control line responsive to a defrost initiation signal. A second control line across the source includes, in series, a system defrost control relay coil, normally closed blow down timer contacts, normally open defrost initiate relay contacts. A third control line across the source comprises, in series, a blow down timer relay coil, normally closed defrost initiate relay contacts and normally open system defrost control relay coil contacts. A fourth control line across the voltage source includes, in series, a fan reverse coil, normally closed defrost initiate relay coil contacts and normally open system defrost control relay coil contacts. A fifth line includes normally open reverse fan coil contacts and a reverse fan relay coil for shifting the fan motor from operation in a first direction causing air flow upwardly over said fins to a reverse direction causing downward air flow. The system further comprises normally open system defrost control relay contacts within the system defrost control to effect reversal of refrigerant flow within the outdoor coil tubing. Receipt of a defrost initiation signal at the control panel causes initial energization of the defrost initiate relay coil, energization of the system defrost control relay, and closure of the normally open contacts within the system defrost control line. Subsequently, upon receipt of a termination defrost control signal by the control panel within the first line and de-energization of the defrost initiate relay coil, the blow down timer coil is energized within the third line and the system defrost control relay coil continues its energization within the second line. The fan reverse coil within the fourth line is energized to cause the fan reversal relay coil to operate within the fifth line to re-energize the fan motor for rotation in the opposite direction and force air flow downwardly over the coil fins until termination of energization of the system defrost control relay coil within the second line by opening of the normally closed blow down timer contacts within the second line to return the heat pump system to normal heating mode operation.

Preferably, a sixth line is connected to the voltage source and includes a fan forward coil and normally closed interlock fan reverse contacts, and the fourth line includes normally closed fan forward interlock contacts to prevent energization of the fan motor in both forward and reverse mode.

In order to insure continued energization of the system defrost control relay coil subsequent to de-energization of the defrost initiate relay coil, normally open system defrost control relay holding contacts are provided within the second line shunting the normally open defrost initiate relay coil contacts.

The termination defrost control signal may emanate from a thermostat mounted to the outdoor coil so as to sense the temperature of the refrigerant within the outdoor coil.

BRIEF DESCRIPTION OF THE DRAWINGS

FIG. 1A is a partial, vertical, sectional view of the outdoor coil of a heat pump system incorporating the improved reverse fan defrost control system of the present invention, with the heat pump in heating mode prior to defrost.

FIG. 1B is a sectional elevational view of the portion of the heat pump of FIG. 1A during the initial defrost cycle with the fan motor stopped.

FIG. 1C is a sectional elevational view of the portion of the heat pump of FIGS. 1A and 1B during the reverse fan, delayed defrost termination operation of the present invention.

FIG. 2 is an electrical schematic diagram of the improved reverse fan defrost control system for the heat pump partially illustrated in FIGS. 1A–1C inclusive.

DESCRIPTION OF THE PREFERRED EMBODIMENT

Referring to the drawings, there is shown in FIGS. 1A–1C inclusive, only the portions of a typical heat pump or reversible refrigeration system that are necessary to illustrate the function and componentry of that heat pump, to which the improved reverse fan defrost termination delay control system of the present invention has application. In that regard, in addition to the conventional indoor coil, the compressor and the reversing valve of the heat pump system (all not shown), there is provided an outdoor coil indicated generally at 10 and consisting of an elongated, rectangular casing 12 mounted by way of legs 14 and supporting internally of the casing one or more turns of outdoor coil tubing 16. The tubing 16 extends generally horizontally across the outdoor coil and within casing 12 from one side to the other, and the tubing 16 fixedly bearing a plurality of vertical, spaced heat exchange fins 18 which are parallel to each other, formed of metal and which define multiple air flow paths between the fins. In this regard, the bottom of the casing is open, as at 20, and the top wall 22 of the casing 12 is provided with an annular shroud 24 which defines a circular opening providing a vertical flow path for the air which passes over the fins. The air is forced in FIG. 1A by way of operation of a fan indicated generally at 26 and consisting of a reversible electric motor M mounted to the top wall 22 of the casing by way of radial arms as at 28 joined to central collar 30 which surrounds the motor. The motor is provided with a shaft 32 which depends from the lower end of the motor casing and bears a fan blade 34 for rotation about the axis of the shaft 32, shown in a counterclockwise direction, FIG. 1A, under normal heat pump heating and cooling modes with the outdoor coil 10 functioning either as an evaporator or a condenser and the air flow being vertically upward as indicated by arrows 36. Under heating mode of operation, refrigerant may pass through the tubing 16 in the direction of arrows 38 after expanding by way of an expansion device or the like (not shown), so as to absorb heat from the air passing through the outdoor coil. The refrigerant exiting from the opposite end of the tubing 16 and returns to the suction side of the compresser (not shown).

When the outdoor coil 10 operates at close to freezing and with moisture in the air, there is a tendency for the moisture to condense on the fins 18, and since the temperature of the fins is below freezing, the moisture freezes into frozen condensate as at 40. As may be seen, the presence of the frost at 40 inhibits air flow between the fins. This results in an increase in the temperature for the refrigerant within the tube and an increase in the pressure differential between the suction and discharge sides of the compressor, which parameters may be readily measured (by means not shown). A signal $S_1$ indicative of such temperature or pressure differential and requirement for defrost initiation is directed to control panel 42 within a first control line 44 of the reverse fan defrost termination delay electrical control system of the present invention indicated generally at 46, FIG. 2.

Insofar as the apparatus of FIGS. 1A–1B is concerned, there is one additional element which is pertinent to the subject invention. That is, a thermostat or temperature sensor T is mounted to the tubing 16 adjacent the fin area and sensitive to the temperature of the refrigerant within the outdoor coil tubing 16. This thermostat T provides a second control signal $S_2$ which is directed also to the control panel 42 through line 47 and acts as the second of two necessary control signals for achieving the controlled defrost operation of the present invention.

Turning to FIG. 2, it may be seen that electrical lines $L_1$ and $L_2$ constitute a source of electrical current for the control system, in this case, for control lines 44, 48, 50, 52, 54 (via contacts 60) and 56. Further, with respect to the reversible drive motor M for fan 26, this motor M constitutes for example a three phase electrical induction motor, and the motor is supplied with three phase current via lines 62, 64 and 68 for phases A, B and C, respectively. A fan energization relay switch 70 permits energization of the motor M or de-energization by connecting to or disconnecting from motor M, all three phases.

In addition, the control system of the present invention includes a reverse fan relay indicated generally at 72 including relay coil 74 and paired movable switch contacts 76 and 78 which shift in position from fixed contacts 80 and 82, respectively, to fixed contacts 84 and 86, respectively, to cause the motor windings 88 and 92 to be energized, respectively, to phases A and B and vice versa. Winding 90 is always energized by way of line 68 to the same phase C of the three phase supply. Normally, with windings 88 and 92 coupled to lines 62 and 64, respectively, the motor M drives the fan F in a direction as shown in FIG. 1A, counterclockwise with the air flow being upwardly with respect to the fins 18 of the outdoor coil 10.

In response to energization of the reverse fan relay coil 74 of relay 72, the armature indicated by dotted line **74*a* is shifted in the direction of the arrow, FIG. 2, to move movable contacts 76 and 78 to fixed contacts 84 and 86, respectively, causing the motor M to be energized so as to reverse the direction of rotation of fan blade 34. With the fan rotating clockwise, FIG. 1C, the direction of air flow is vertically downward as at 94** in that figure.

The purposes for such reversal and its effect may be best appreciated by a discussion of the sequence of operation of the control system components by further referral to the control system of FIG. 2. In that regard, the first line 44 of the control system includes in addition to panel 42 a defrost initiate relay coil ICR. The panel 42 is provided with contacts within line 44 responsive to the receipt of the control signal $S_1$, which close to initiate defrost action by closure of the circuit defined by line 44 and energization of the defrost initiate relay coil ICR. Line 50, which is also between source lines $L_1$ and $L_2$, includes in series, normally open ICR contacts 96, normally closed blow down timer ITR contacts 98, and a system defrost control relay coil 2CR. Control line 52 includes in series, normally open system defrost control relay 2CR contacts 100, normally closed defrost initiate relay ICR contacts 102, normally closed fan forward 1M contacts 104 and the fan reverse relay coil 2M. Line 48 across source lines $L_1$ and $L_2$ provides in series, a circuit including normally open system defrost control relay 2CR contacts 106, normally closed defrost initiate relay ICR contacts 108, and a blow down timer coil ITR.

Additionally, a line 56 which is connected at one end to line $L_2$ connects at its opposite end to a fan control circuit internally within the building being conditioned (not shown) and responsive to normal heat pump operation in a heating or cooling mode. It includes normally closed fan reverse interlock contacts 2M as at 110, and a fan forward relay coil 1M. These function along with fan reverse coil 2M within line 52 and normally closed fan forward relay 1M contacts 104 as electrical interlocks to insure that the windings 88, 90 and 92 of fan motor M cannot be simultaneously energized for both forward and reverse rotation of the motor M.

Further, line 50 includes a portion **50*a* which is shunted across the defrost initiate relay ICR contacts 96 and bears normally open system control defrost relay 2CR contacts 112, which constitute holding contacts for the system defrost control relay coil 2CR to insure that regardless of whether the defrost initiate relay coil ICR is energized or not, a circuit will be completed to the system defrost control relay coil 2CR**.

Further, as mentioned previously, internally within the building and preferably in the vicinity of the compressor and indoor coil, there are provided additional controls for operating the heat pump in either its heating or cooling mode and responsive to certain parameters including the temperature of the space being conditioned. In that regard, once control panel 42 is in receipt of the signal $S_1$ indicating the necessity for defrost of the outdoor coil, there is required to be fed from the control system of FIG. 2 which may be located at the outdoor coil or adjacent thereto, a signal back to the building components of the heat pump system in initiate certain actions for the heat pump including the compressor and reversing valve, to reverse the flow of refrigerant within the heat pump system and specifically tubing 16 of the outdoor coil, such that the outdoor coil during defrost mode (cooling mode insofar as the reversible refrigeration system is concerned) is the reverse to that normally occurring when the outdoor coil functions as an evaporator. Thus, there is a change in the direction of the flow, as per arrows at at 38' in FIGS. 1B and 1C, through the coil during defrosting of the outdoor coil.

In that regard, a totally spearate control line 114 is provided for the system, in FIG. 2, leading to the heat pump componentry internally of the building being conditioned (not shown) and bearing normally open system defrost control relay 2CR contacts at 116.

Within line 54, in addition to the reverse fan relay coil 74, in series therewith, are normally open, fan reverse 2M contacts 118. It is upon the closure of these contacts 118 that the coil 74 is energized and the armature shifted downwardly to switch movable contacts 76 and 78 from fixed contacts 80 and 82, respectively, to fixed contact 84 and 86, respectively. Additionally, fan energization relay coil 120 of relay 70 within line 122 is energized and armature 124 fixed to individual movable switch contacts 126, 128, and 130 effects fan motor M energization. Line 122 from the building interior heat pump control system carries normally closed interlock 1CRC contacts 73, such that automatically when defrost initiate relay coil 1CR is energized and throughout most of the defrost mode the fan motor M is prevented from being energized as contacts 73 are maintained open. Line 122 is energized in response to a control signal emanating from the heat pump system componentry internally of the building and conditioned to cause the fan motor M to be energized.

The sequence of operation of the defrost termination delay and reverse fan control system of the present invention may be appreciated from the following description with reference to the figures.

The accumulation of frost condensate as at 40 on the fins 18 of the outdoor coil 10 with the outdoor coil 10 acting as an evaporator in a heat pump heating mode, results in a pressure differential$\Delta P$ of predetermined magnitude between the suction and discharge sides of the compressor (not shown). Whereupon, a control signal $S_1$, FIG. 2, derived therefrom is applied to the control panel 42 resulting in closure of the circuit between lines $L_1$ and $L_2$ for control line 44 bearing the defrost initiate relay coil ICR. Energization of the defrost initiate relay coil ICR results in the closure of normally open ICR contacts 96 within line 50 and since the blow down timer ITR contacts 98 within that line are closed, system defrost control relay coil 2CR is immediately energized. Simultaneously, the normally closed ICR contacts 108 within line 48, which includes the blow down timer coil ITR, open so that the blow down timer coil ITR remains de-energized, even though normally open system defrost control relay 2CR contacts 106 close within that line. Further, while system defrost control relay 2CR contacts 100 within line 52 close as a result of energization of the system defrost relay coil 2CR, due to the presence of the defrost initiate relay ICR normally closed contacts 102 within the same line 52 which now open the reverse fan relay 2M remains de-energized. Energization of the system defrost control relay coil 2CR also closes the normally open 2CR contacts 116 within line 114 which leads to the system components within the building being conditioned, causing the heat pump mode to change from heating mode to cooling mode, such that refrigerant no longer flows from the indoor coil to the outdoor coil in the manner of arrow 38, FIG. 1A, but is now sent directly from the compressor due to shifting of the reversing valve and flows in reverse, as at 38', to the outdoor coil 10, as per FIG. 1B, during the full extent of defrost operation. The hot compressed refrigerant vapor discharging from the compressor acts to cause the frozen condensate to melt, the condensate running down the fins 18 and dropping as indicated by liquid droplets 132, FIG. 1B. It is also noted that in FIG. 1B, that as a result of the control signal from the line 114, energization of coil 120 results in opening of the movable contacts 126, 128 and 130 and de-energization of the drive motor M, since all three windings 88, 90 and 92 are taken off of the three phases A, B and C lines 62, 64 and 68.

As described to this point, the defrosting of the outdoor coil is in all respects typical of current practice. Normally, after a predetermined period of time, and along with a signal indicative of a condition in which the frost is essentially totally melted, a rise in temperature of the refrigerant within tubing 16 of the outdoor coil 10, as provided by thermostat or temperature sensor T, would be sufficient to cause termination of defrosting and return of the heat pump system to heating mode, wherein the outdoor coil 10 would again function as an evaporator coil.

As mentioned previously, this would result in the immediate refreezing of any condensate or water droplets remaining on the fins which have not dropped off the fins by gravity action, as per 132, FIG. 1B, particularly with the fan motor M de-energized.

At the time of initiation of defrost action, upon receipt of signal $S_1$, since normally closed ICR contacts 102 within line 52 are closed, there can be no energization of the fan motor in reverse direction as fan reverse coil 2M remains de-energized. Appropriately, the control means via the defrost initiate relay coil 1CR and contacts 73 insures de-energization of coil 120 through line 122 and shut down of fan motor M until receipt of the second control signal $S_2$ by the control panel 42 within line 44. At that point, movable contacts 126, 128 and 130 close the motor winding circuit to respective lines 62, 64, and 68, as coil 120 is energized via line 122 and normally closed ICR contacts 73. In the present system, upon receipt of a second signal $S_2$, indicating that the defrost should be terminated, this signal $S_2$ acts to open switch (not shown) within line 144 and provided within control panel 42, to de-energize the defrost initiate relay coil 1CR. It may be seen that this causes the normally open ICR contacts 96 within line 50 to open. However, since 2CR holding contacts 112 within line **50*a* are closed, the system defrost control relay coil 2Cr continues to be energized and the heat pump system continues to operate in defrost mode. Further, since the normally closed ICR contacts 108 within line 48 now close as a result of de-energization of the defrost initiate relay coil 1CR, the blow down timer coil ITR is energized. This sets up a predetermined interval of time for delay of termination of defrost, and subsequent to the expiration of that time period, the normally closed ITR contacts 98 within the line 50 open. However, prior to this, since within line 52 the normally closed ICR contacts 102 close as a result of the de-energization of the defrost initiate relay coil 1CR, the fan reverse coil 2M is energized. This causes the normally open fan reverse 2M contacts 118 within line 57 to close, energizing the reverse fan relay coil 74 and causing the movable contacts 76 and 78 to close on fixed contacts 84 and 86 and effecting reversal of the fan motor M to drive the fan in a clockwise direction, FIG. 1C, blowing air downwardly and over the coil in the same direction as gravity and to enhance the final removal of the liquid condensate on the fins 18** during the delay defrost termination.

The function of the control system of the present invention is simply to insure that for a predetermined period of time, that is, for several minutes, as an example, the heat pump will operate in continual defrost or modified cooling mode with the fan motor M energized in fan reverse so as to blow down the water from the fins as indicated at 132' FIG. 1C, this forced air movement acting in conjunction with gravity to rapidly dissipate any remaining condensate liquid on the fins. During that period, with the fan reverse coil 2M energized, the normally closed 2M contacts 100 within line 58 bearing the fan forward coil 1M being open, there is no way that the fan motor may be energized in a forward direction. Thus, relay contacts 100 and 102 within lines 58 and 52, respectively, function as electrical interlocks with respect to the fan reverse and fan forward coils.

After a period of time, the blow down timer ITR contacts 98 within line 50 open, de-energizing the system defrost control relay coil 2Cr and contacts 2CR within line 50*a* open to take line 50 off the supply, with 2CR contacts 100 within line 52, and 106 within line 48, taking those lines off the supply, so that all of the coils are de-energized, and the system is essentially in the condition as described previous to the receipt of the first control signal $S_1$ for initiation of defrost operation.

None of the coils being energized, the fan may be driven in a fan forward direction by appropriate controls within the building being conditioned, since the interlock 2M contacts 100 are closed within line 58 including the fan forward relay coil 1M.

While the invention has been particularly shown and described with reference to a preferred embodiment thereof, it will be understood by those skilled in the art that various changes in form and details may be made therein without departing from the spirit and scope of the invention.

What is claimed is:

1. In a heat pump including a finned outdoor coil acting selectively as a refrigeration condenser and evaporator and having a fan mounted adjacent the coil for blowing air upwardly and across the coil fins for effecting heat exchange between the moving air and refrigerant within the coil tubing, said heat pump including control means responsive to frost accumulation on the fins of said outdoor coil when said outdoor coil is acting as an evaporator under near-freezing ambient conditions for effecting a change in heat pump operation from heating mode to cooling mode and to thereby initiate defrosting of the coil by supplying hot refrigerant vapor to said coil and for terminating fan operation, the improvement comprising: said fan being a reversible direction fan, and said control means further comprising means for first delaying the termination of the heat pump cooling mode for defrost operation and the initiation of the heating mode, and secondly, for reversing the direction of forced air flow over the coil such that the air flow acts in conjunction with gravity to remove the last of the melted condensate from the fins.

2. The heat pump as claimed in claim 1, wherein said control system comprises an electrical voltage source, a defrost initiate relay and means responsive to frost accumulation on said outdoor coil for connecting said defrost initiate relay coil to said voltage source, a system defrost control relay coil, and means responsive to energization of said defrost initiate relay coil for energizing said system defrost control relay coil, means responsive to energization of the system defrost control relay coil for changing heat pump mode from heating to cooling and delivery of hot, compressed refrigerant vapor to said outdoor coil for heating of the fins and said coil to melt said frozen condensate, a fan reverse coil and means for connecting said fan reverse coil to said voltage source in response to control system receipt of a signal indicative of termination of heat pump defrost operation for de-energization of the defrost initiate relay, tending to de-energize the system defrost control relay coil and for energization of said fan reverse relay coil, and means responsive to energization of said fan reverse relay coil for energizing said fan motor in a reverse direction to cause downward air flow over the coil fins, and means for delaying the de-energiation of the system defrost relay coil in response to de-energization of said defrost initiate relay coil, until all of said frozen condensate is melted and is subsequently blown off by said reverse fan forced air flow.

3. The heat pump as claimed in claim 2, wherein said delay means comprises a blow down timer coil and means for connecting said blow down timer coil to said voltage source in response to de-energization of said defrost initiate relay coil and normally closed blow down timer contacts in series with said system defrost relay coil, such that subsequent to energization of said blow down timer coil for a predetermined period of time, said normally closed blow down timer contacts open to de-energize said system defrost control relay coil and to finally terminate the defrost operation of the heat pump and cause said heat pump to revert to heating mode.

4. The heat pump as claimed in claim 1, wherein said fan comprises a reversible, electrical fan drive motor, and said control system comprises an electrical voltage source, a first control line connected across said electrical voltage source including in series a defrost initiate relay coil and a control panel including means for selectively closing said first control line in response to a defrost initiate signal and for operating said first control line in response to a defrost termination control signal, a second control line across said electrical voltage source including in series a system defrost control relay coil, normally closed blow down timer contacts, and normally open defrost initiate relay contacts, a third control line across said electrical voltage source including in series a blow down timer relay coil, normally closed defrost initiate relay contacts and normally open system defrost control relay coil contacts, a fourth line across said electrical voltage source including in series a fan reverse coil, normally closed defrost initiate relay coil contacts and normally open system defrost control relay contacts, a fifth line across said electrical voltage source including normally open reverse fan coil contacts and a reverse fan relay coil for reversing the fan motor windings for reversing fan motor rotation from a first direction causing air flow upwardly over the fins to one in which air flows downwardly over said fins, and means effecting reversal of refrigerant flow within the outdoor coil tubing; whereby, receipt of a defrost initiate control signal at said control panel causes initial energization of the defrost initiate relay coil, energization of the system defrost control relay and closure of the normally open contacts within the system defrost control line, and subsequently, upon receipt of a defrost termination control signal at said control panel, said defrost initiate relay coil is de-energized, said system defrost control relay coil within said second line continues its energization and the blow down timer coil within said third line and the fan reverse coil within said fourth line are energized to cause fan reversal to force air flow downwardly over the coil fins and maintain heat pump defrost operation until termination of the energization of the defrost control relay coil within said second line by opening of the normally closed blow down timer contacts and subsequent return of the heat pump system, to normal heating mode.

5. The heat pump as claimed in claim 4, wherein said control system further comprises a sixth line connected to said electrical voltage source and including a fan forward coil and normally closed interlock fan reverse contacts, and said fourth line further comprising normally closed fan forward interlock contacts, such that said interlock contacts within said sixth line and said fourth line prevent energization of said fan motor in both forward and reverse directions simultaneously.

6. The heat pump as claimed in claim 4, further comprising normally open system defrost control relay holding contacts within said second line shunting said normally open defrost initiate relay coil contacts, such that subsequent to de-energization of said defrost initiate relay coil in receipt of said control signal, the system defrost control relay coil is continued in its energization for a time period determined by the extent of closure of said blow down timer coil contacts within said second control line.

7. The heat pump as claimed in claim 5, further comprising normally open system defrost control relay holding contacts within said second line shunting said normally open defrost initiate relay coil contacts, such that subsequent to de-energization of said defrost initiate relay coil in receipt of said control signal, the system defrost control relay coil is continued in its energization for a timer period determined by the extent of closure of said blow down timer coil contacts within said second control line.

* * * * *